US010741908B2

(12) United States Patent
Sanders et al.

(10) Patent No.: US 10,741,908 B2
(45) Date of Patent: Aug. 11, 2020

(54) ANTENNA SYSTEM AND ANTENNA MODULE WITH REDUCED INTERFERENCE BETWEEN RADIATING PATTERNS

(71) Applicant: TE Connectivity Nederland BV, s'Hertogenbosch (NL)

(72) Inventors: Philip Ludovic E. Sanders, Antwerp (BE); Wijnand van Gils, Raamsdonksveer (NL)

(73) Assignee: TE Connectivity Nederland BV, S'Hertogenbosch (NL)

( * ) Notice: Subject to any disclaimer, the term of this patent is extended or adjusted under 35 U.S.C. 154(b) by 204 days.

(21) Appl. No.: 15/239,068

(22) Filed: Aug. 17, 2016

(65) Prior Publication Data

US 2017/0054214 A1 Feb. 23, 2017

(30) Foreign Application Priority Data

Aug. 18, 2015 (EP) ..... 15181448

(51) Int. Cl.

| | |
|---|---|
| ***H01Q 9/04*** | (2006.01) |
| ***H01Q 1/52*** | (2006.01) |
| ***H01Q 1/32*** | (2006.01) |
| ***H01Q 15/00*** | (2006.01) |
| ***H01Q 9/42*** | (2006.01) |
| ***H01Q 5/314*** | (2015.01) |

(Continued)

(52) U.S. Cl.

CPC ..... *H01Q 1/521* (2013.01); *H01Q 1/3275* (2013.01); *H01Q 1/38* (2013.01); *H01Q 5/314* (2015.01); *H01Q 9/0421* (2013.01); *H01Q 9/0428* (2013.01); *H01Q 9/0442* (2013.01); *H01Q 9/42* (2013.01); *H01Q 15/006* (2013.01); *H01Q 15/0026* (2013.01); *H01Q 15/0086* (2013.01); *H01Q 21/28* (2013.01)

(58) Field of Classification Search

CPC ..... H01Q 1/3275; H01Q 1/3233; H01Q 1/521

See application file for complete search history.

(56) References Cited

U.S. PATENT DOCUMENTS 6,917,340 B2 * 7/2005 Lindenmeier ..... H01Q 1/521 343/713

8,098,205 B2 1/2012 Rabinovich et al.

(Continued)

FOREIGN PATENT DOCUMENTS

CN 102439791 A 5/2012

CN 103515717 A 1/2014

(Continued)

OTHER PUBLICATIONS

European Search Report, dated Jan. 3, 2016, 11 pages.

(Continued)

*Primary Examiner* — Ab Salam Alkassim, Jr.

(74) *Attorney, Agent, or Firm* — Barley Snyder

(57) ABSTRACT

An antenna system is disclosed. The antenna system comprises a first antenna adapted to a first frequency band and a second antenna adapted to a second frequency band different than the first frequency band. The first antenna has a radiator provided on a first side of a dielectric substrate and at least one resonator provided on a second opposite side of the dielectric substrate. The at least one resonator is partially covered by the radiator and resonates at a frequency in the second frequency band.

18 Claims, 5 Drawing Sheets

(51) Int. Cl.
*H01Q 1/38* (2006.01)
*H01Q 21/28* (2006.01)

(56) References Cited

U.S. PATENT DOCUMENTS

| | | | | |
|---|---|---|---|---|
| 9,153,874 | B2 | 10/2015 | Ouyang et al. | |
| 10,615,509 | B2 * | 4/2020 | Toyao | H01Q 9/285 |
| 2010/0277379 | A1 * | 11/2010 | Lindackers | H01Q 1/1207 343/713 |
| 2010/0283684 | A1 * | 11/2010 | Rabinovich | H01Q 1/3275 343/700 MS |
| 2013/0141297 | A1 * | 6/2013 | Gomme | H01Q 5/35 343/770 |
| 2013/0229315 | A1 * | 9/2013 | Duzdar | H01Q 1/3275 343/713 |
| 2013/0342405 | A1 * | 12/2013 | Ueno | H01Q 1/3275 343/713 |
| 2014/0292593 | A1 * | 10/2014 | Thiam | H01Q 1/3275 343/713 |
| 2015/0236404 | A1 * | 8/2015 | Choi | H01Q 1/36 343/722 |
| 2016/0064807 | A1 * | 3/2016 | Reed | H01Q 1/3275 343/713 |
| 2016/0248154 | A1 * | 8/2016 | Tian | H01Q 1/243 |
| 2017/0054204 | A1 * | 2/2017 | Changalvala | H01Q 1/3291 |
| 2017/0117612 | A1 * | 4/2017 | Toyao | H01Q 1/38 |
| 2017/0125885 | A1 * | 5/2017 | Kosaka | H01Q 1/24 |
| 2018/0062271 | A1 * | 3/2018 | Toyao | H01Q 19/10 |
| 2018/0069326 | A1 * | 3/2018 | Van Gils | H01Q 21/30 |
| 2018/0375212 | A1 * | 12/2018 | Kuo | H01Q 1/243 |

FOREIGN PATENT DOCUMENTS

| | | | | |
|---|---|---|---|---|
| CN | 104064877 | A | 9/2014 | |
| WO | 2010029305 | A1 | 3/2010 | |
| WO | WO 2010029305 | A1 * | 3/2010 | H01Q 1/2291 |
| WO | WO-2010029305 | A1 * | 3/2010 | H01Q 1/2291 |
| WO | 2010129628 | A1 | 11/2010 | |
| WO | 2012101320 | A1 | 8/2012 | |

OTHER PUBLICATIONS

Yamamoto, Takashi, Awai, Ikuo, Sanada, Atsushi, and Kubo, Hiroshi, Coupled Resonators on Both Sides of a Printed Circuit Board and Their Applications, Electronics and Communications in Japan, Part 2, vol. 89, No. 4, 2006, dated Dec. 2004, 10 pages.
Indian Search Report, dated Apr. 6, 2020, 6 pages.
Chinese First Office Action, dated Apr. 28, 2020, 14 pages.
Abstract of CN 103515717, dated Jan. 15, 2014, 1 page.

* cited by examiner

ANTENNA SYSTEM AND ANTENNA MODULE WITH REDUCED INTERFERENCE BETWEEN RADIATING PATTERNS

CROSS-REFERENCE TO RELATED APPLICATION

This application claims the benefit of the filing date under 35 U.S.C. § 119(a)-(d) of European Patent Application No. 15181448.0, filed Aug. 18, 2015.

FIELD OF THE INVENTION

The present invention relates to an antenna system, and more particularly, to an antenna system having a plurality of antennas.

BACKGROUND

Antenna systems having a plurality of antennas are known to provide various structural advantages. Particularly, the assembly of an antenna system in a single structural module allows mechanical and electrical components to be shared between the antennas. The antennas in a known antenna system may, for example, share a housing, a base, PCB circuitry, and exterior electrical connections for transmitting and receiving electrical signals. However, when the antennas within the antenna system are arranged close to each other, the antennas suffer from mutual interference of their respective radiating patterns.

U.S. Pat. No. 6,917,340 relates to an antenna system having two antennas. In order to reduce the coupling and interference effects, one of the two antennas is subdivided into segments which have an electrical length corresponding to three-eighths of the wavelength of the other antenna. Further, the segments of the first antenna are electrically interconnected via electric reactance circuits which possess sufficiently high impedance in the frequency range of the second antenna and sufficiently low impedance in the frequency range of the first antenna.

Even though the teaching of the U.S. Pat. No. 6,917,340 reduces interference in the radiation patterns of the two antennas, the design and assembly of the antenna system is complicated due to the inclusion of the electric reactance circuits. Further, the soldered connection of the electric reactance circuits to the antennas introduces unacceptable frequency variances.

SUMMARY

An object of the invention, among others, is to provide an antenna system which reduces interference between a plurality of antennas within the antenna system without requiring the assembly of additional elements. The disclosed antenna system comprises a first antenna adapted to a first frequency band and a second antenna adapted to a second frequency band different than the first frequency band. The first antenna has a radiator provided on a first side of a dielectric substrate and at least one resonator provided on a second opposite side of the dielectric substrate. The at least one resonator is partially covered by the radiator and resonates at a frequency in the second frequency band.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an antenna system. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1A:
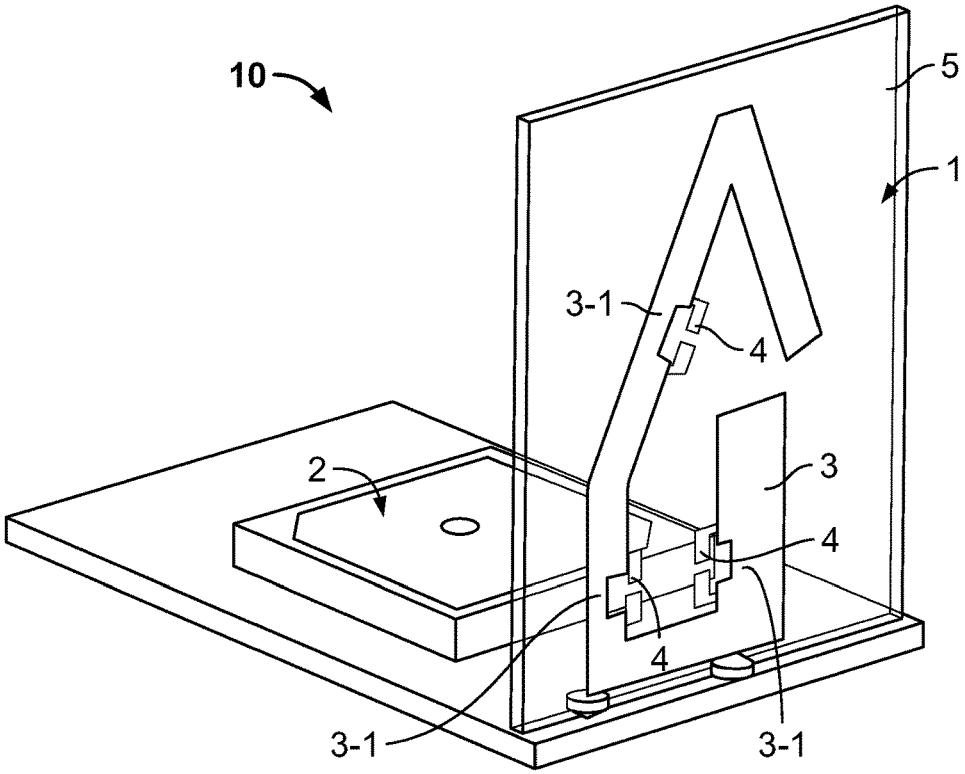
FIG. 1A is a front perspective view of an antenna system according to the invention.
Figure 1B:
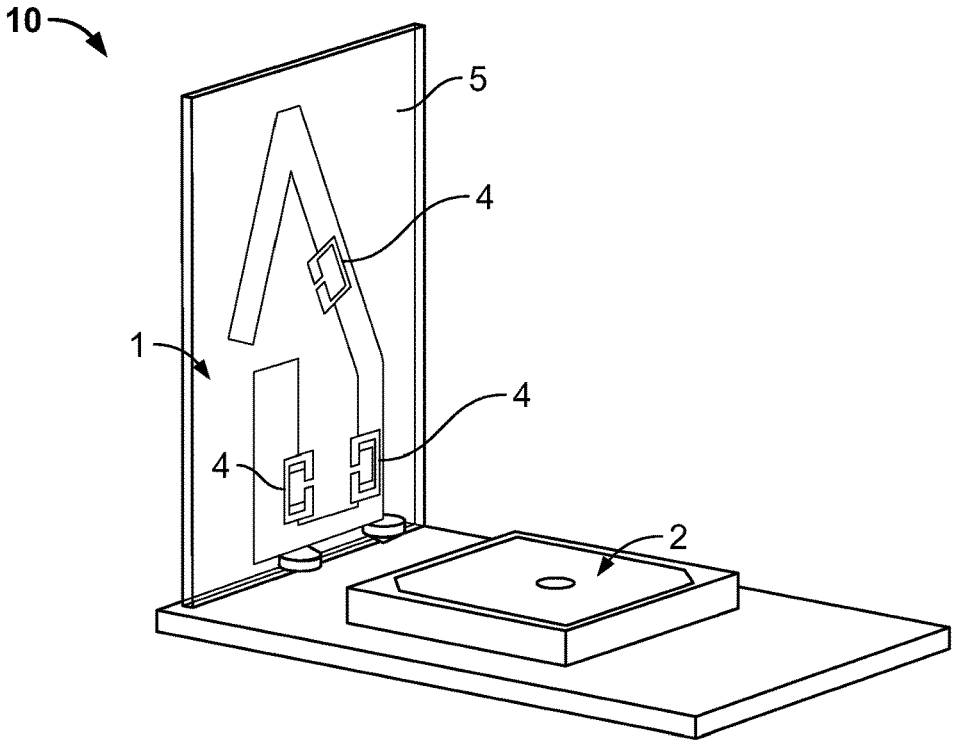
FIG. 1B is a rear perspective view of the antenna system of FIG. 1A.

An antenna system 10 according to the invention is shown generally in FIGS. 1A and 1B. The antenna system 10 has a first antenna 1 and a second antenna 2. The major components of the invention will now be described in greater detail.

The first antenna 1 is shown in FIGS. 1A and 1B as a multi-band antenna. However, the first antenna 1 may alternatively be a monopole antenna, a dipole antenna, a planar inverted-F antenna ("FIFA"), or a differently configured multi-band antenna known to those with ordinary skill in the art. The first antenna 1 comprises a radiator 3, at least one resonator 4, and a dielectric substrate 5.

The radiator 3, as shown in FIG. 1A, is a radiating conductor provided on a first side of the dielectric substrate 5. The radiator 3 may have a plurality of sections adapted to radiate at different frequencies within a first frequency band. The at least one resonator 4 is a resonating conductor provided, at least in part, on a second opposite side of the dielectric substrate 5. Accordingly, the radiator 3 and the at least one resonator 4 are provided, at least in part, on opposite sides of the dielectric substrate 5. Both the radiator 3 and the at least one resonator 4 may be manufactured by printing, etching or electro-depositing a conductor on the respective sides of the dielectric substrate 5. Thereby, additional assembly steps can be avoided when manufacturing the antenna system 10.

The dielectric substrate 5 may have a planar configuration or a non-planar configuration. In a planar embodiment, the dielectric substrate 5 is a thin-layered structure similar to a printed circuit board. In a non-planar embodiment, the dielectric substrate 5 is a thin curved structure with equidistant inside and outside surfaces. The planar or non-planar dielectric substrate 5 may be an injection-molded plastic carrier with thickness in the range 0.5 mm to 1.0 mm. For a planar dielectric substrate 5, the radiator 3 may be planar, and the at least one resonator 4 may also be planar. Alternatively, for a non-planar dielectric substrate 5, the radiator 3 and the at least one resonator 4 may both be non-planar or curved members.

The at least one resonator 4 is an open-loop type resonator in the embodiment shown in FIGS. 1A and 1B. The at least one resonator 4 is configured to resonate at a frequency in a second frequency band. Accordingly, the dimensions of the at least one resonator 4 are determined in accordance with the frequency of the second frequency band. More particularly, a gap width, conductor width, and path dimensions of the open-loop resonator 4 are appropriately determined so as to match the frequency in the second frequency band.

The at least one resonator 4 is provided at close proximity to the radiator 3 due to their arrangement, at least in part, on opposite sides of the dielectric substrate 5. The at least one resonator 4 and the radiator 3 are separated, at least in part, by the thickness of the dielectric substrate 5. The at least one resonator 4, as shown in FIGS. 1A and 1B, is disposed opposite the radiator 3 such that a portion of the at least one resonator 4 on the second side of the dielectric substrate 5 overlaps with or covers the radiator 3 on the first side of the dielectric substrate 5. The at least one resonator 4 has covered segments overlapping with the radiator 3, and uncovered segments not overlapping with the radiator 3.

The only partly covered arrangement of the at least one resonator 4 with respect to the radiator 3 permits a more flexible antenna design. Particularly, the dimensions of the at least one resonator 4 can be set freely and independently of the type of radiator 3 employed for the first antenna 1.

The second antenna 2 is shown in FIGS. 1A and 1B as a planar antenna, namely as a corner-truncated patch antenna. However, the second antenna 2 may alternatively be any other type of antenna known to those with ordinary skill in the art.

In the embodiment shown in FIGS. 1A and 1B, the first antenna 1 and the second antenna 2 both have planar configurations. However, the first antenna 1 and the second antenna 2 may alternatively have a non-planar configuration such as a curved structure.

The function of the antenna system 10 will now be described in greater detail with reference to FIGS. 1A and 1B.

The first antenna 1 and second antenna 2 are arranged in the near-field to each other. Accordingly, the radiation pattern of the second antenna 2 is exposed to interference effects from the first antenna 1 and vice versa. In the context of the invention, the term near-field is understood as the region around each of the first antenna 1 and second antenna 2 where a radiating pattern of each is dominated by interference effects from the respective other of the first antenna 1 and second antenna 2. For example, if a length of each of the first antenna 1 and second antenna 2 is shorter than half of the wavelength $\lambda$ the antenna 1, 2 is adapted to emit, the near-field is defined as the region with a radius r, where $r<\lambda$.

The first antenna 1 is adapted to transmit and receive electromagnetic waves of a first frequency band. The second antenna 2 is adapted to transmit/receive electromagnetic waves of a second frequency band. The first frequency band and the second frequency band are different from each other, and accordingly, have no overlap in frequency with each other. However, if one or both antennas 1 and 2 are multi-band antennas, the first frequency band may encompass the second frequency band.

Due to the at least one resonator 4 being partly covered by the radiator 3 on reverse sides of the dielectric substrate 5, the at least one resonator 4 is inductively coupled with the radiator 3. The inductive coupling between the radiator 3 and the at least one resonator 4 is stronger as the thickness of the dielectric substrate 5 decreases. The at least one resonator 4 and the radiator 3 act together as a transformer, inducing a current from the radiator 3 into the at least one resonator 4 and vice-versa.

The resonator 4, by resonating at a frequency in the second frequency band, acts as a stop-band filter within the first antenna 1, suppressing frequencies in the second frequency band being different from the first frequency band at which the radiator 3 is adapted to radiate. The combination of the radiator 3 and the at least one resonator 4 thus suppresses radiation of the first antenna 1 at frequencies in the second frequency band to which the second antenna 2 is adapted. In other words, the radiator 3 and at least one resonator 4 of the first antenna 1 reduce interference effects with the second antenna 2 of the antenna system 10.

In an embodiment, the radiator 3 has at least one indent 3-1, as shown in FIG. 1A, in order to further enhance the inductive coupling with the at least one resonator 4. The radiator 3 has a reduced width at the indent 3-1, which covers a segment of the at least one resonator 4. The indent 3-1 has an opening pointing toward an uncovered segment of the at least one resonator 4 and facing a same direction as the at least one resonator 4. In the context of the invention, the width of the radiator 3 shall be understood as the dimension of the radiator 3 extending laterally with respect to the surface of the dielectric substrate 5 on which it is provided. The indent 3-1 enhances the impedance transformation ratio between the radiator 3 and the at least one resonator 4, and hence, improves the useful bandwidth of the effective current cut.

FIGS. 2A-6B show other embodiments of the first antenna 1 for use in antenna systems. The different configurations of the first antenna are to be used in embodiments of an antenna system additionally comprising the second antenna 2 as described above. Accordingly, the embodiments described below adopt the same principles and advantages already discussed above, which have been omitted for reasons of conciseness.

Figure 2A:
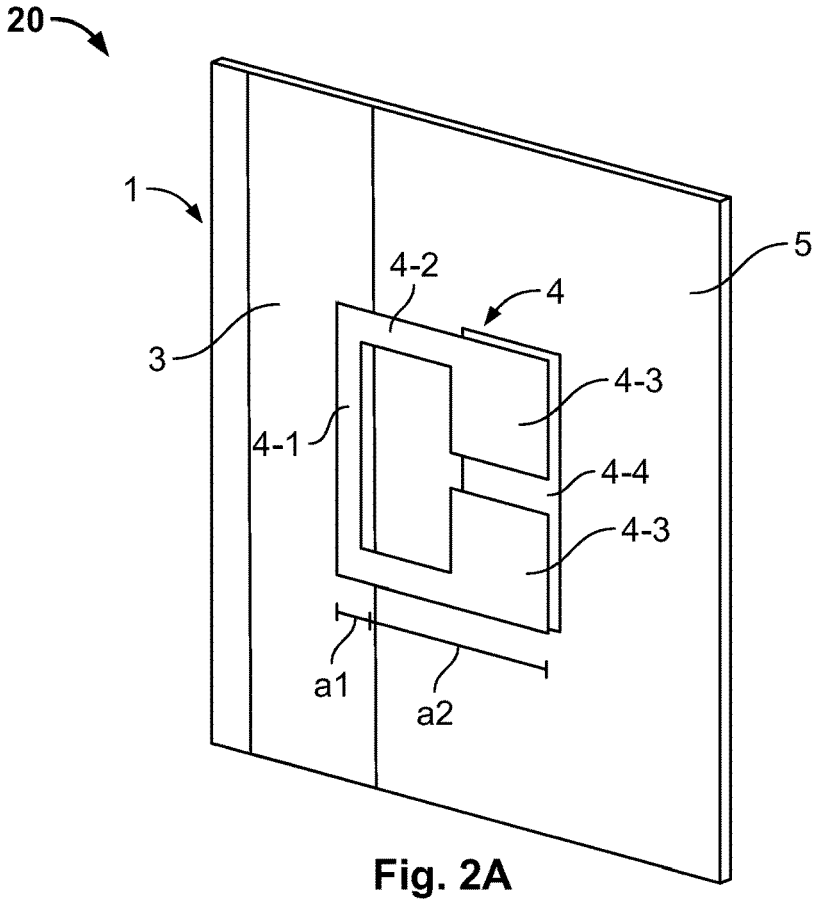
FIG. 2A is a perspective view of a first antenna of an antenna system according to the invention.

An antenna system 20 according to the invention is shown in FIG. 2A. The antenna system 20 comprises a first antenna 1 and a second antenna 2. The first antenna 1 has a radiator 3, at least one resonator 4, and a dielectric substrate 5. The radiator 3 is a radiating conductor provided on a first side of a dielectric substrate 5.

The at least one resonator 4 has a first resonating conductor 4-1, 4-2, and 4-3 which is provided on the second, reverse side of the dielectric substrate 5. The first resonating conductor 4-1, 4-2, and 4-3, as shown in FIG. 2A, has a plurality of segments 4-1, 4-2, and 4-3 formed in an open loop with a gap formed between two end segments 4-3 thereof. The first resonating conductor 4-1, 4-2, 4-3 is disposed occupying an area which in part is covered by the radiator 3. As shown in FIG. 2A, the first segment 4-1 is covered by the radiator 3, while the intermediate and end segments 4-2, 4-3 are not covered by the radiator 3.

The at least one resonator 4 also has a second resonating conductor 4-4 which is provided on the first side of the dielectric substrate 5, spatially separated from the radiator 3. The second resonating conductor 4-4 is partially covered by the end segments 4-3 of the first resonating conductor 4-1, 4-2, 4-3, and separated from the end segments 4-3 by the thickness of the dielectric substrate 5.

Figure 2B:
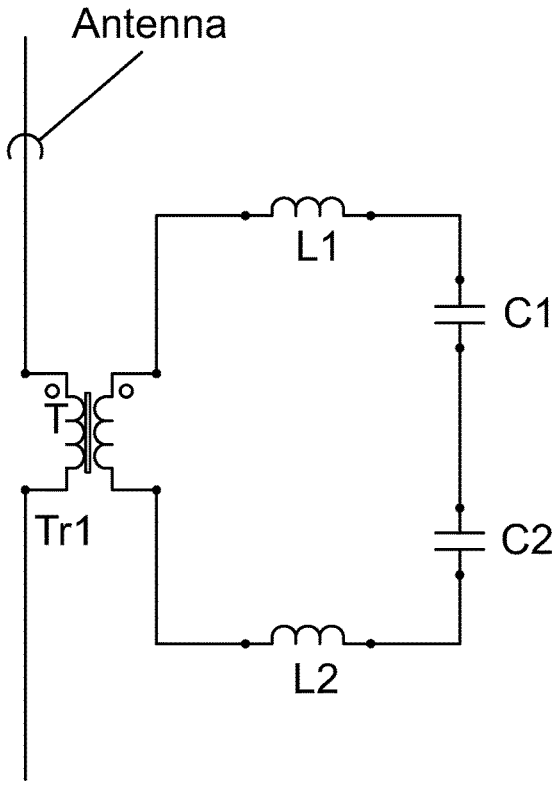
FIG. 2B is a schematic view of an equivalent circuit of the first antenna of FIG. 2A.

Due to configuration of the at least one resonator 4 in FIG. 2A, the end segments 4-3 of the first resonating conductor and the covered portions of the second resonating conductor 4-4 are capacitively coupled, and more precisely are two serially connected capacitors as can be seen from the equivalent circuit of the antenna 1 shown in FIG. 2B. The additional capacitive loading of the open-loop resonator type resonator 4 improves the ability of the resonator 4 to resonate at a frequency within the second frequency band.

In an embodiment, each of the end segments 4-3 has an enlarged width at an end compared to the first and intermediate segments 4-1 and 4-2, as shown in FIG. 2A. Consequently, the surface area covered by the first resonating conductor 4-1, 4-2, 4-3 and the second resonating conductor 4-4 increases, thereby resulting in further improved capacitive loading.

Figure 3A:
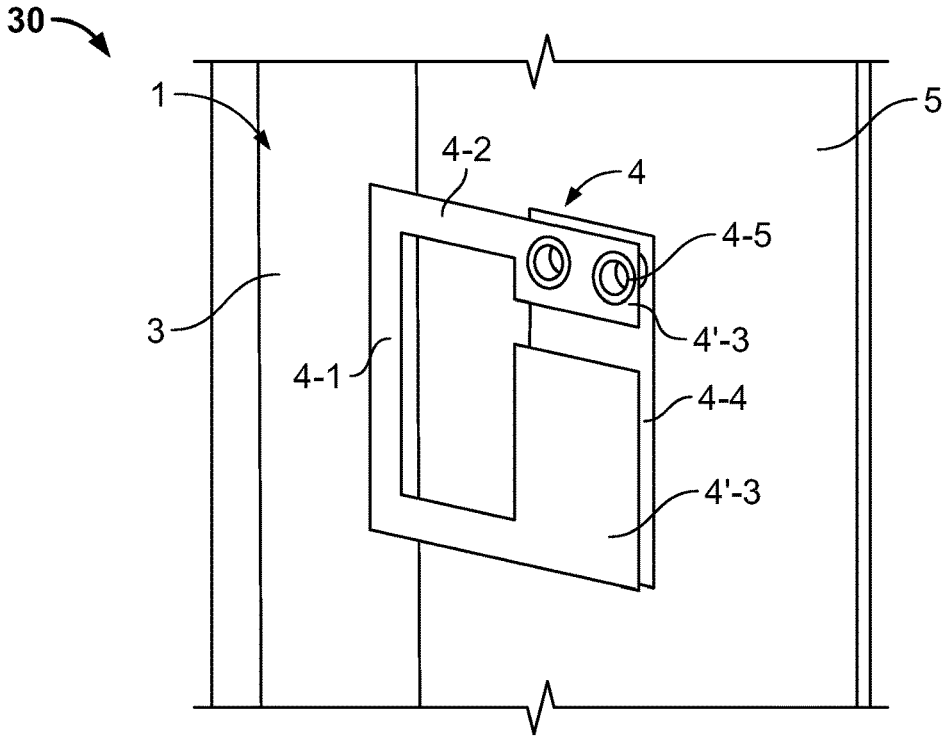
FIG. 3A is a perspective view of a first antenna of an antenna system according to the invention.

An antenna system 30 according to the invention is shown in FIG. 3A. The antenna system 30 comprises a first antenna 1 and a second antenna 2. The first antenna 1 has a radiator 3, at least one resonator 4, and a dielectric substrate 5. The radiator 3 is a radiating conductor provided on a first side of a dielectric substrate 5.

The at least one resonator 4 has a first resonating conductor 4-1, 4-2, and 4'-3 which is provided on the second, reverse side of the dielectric substrate 5. The first resonating conductor 4-1, 4-2, and 4'-3, as shown in FIG. 3A, has a plurality of segments 4-1, 4-2, and 4'-3 formed in an open loop with a gap formed between two end segments 4'-3 thereof. The first resonating conductor 4-1, 4-2, 4-3 is disposed occupying an area which in part is covered by the radiator 3. As shown in FIG. 3A, the first segment 4-1 is covered by the radiator 3, while the intermediate and end segments 4-2, 4'-3 are not covered by the radiator 3.

The at least one resonator 4 also has a second resonating conductor 4-4 which is provided on the first side of the dielectric substrate 5, spatially separated from the radiator 3. The second resonating conductor 4-4 is partially covered by the end segments 4'-3 of the first resonating conductor 4-1, 4-2, 4'-3, and separated from the end segments 4'-3 by the thickness of the dielectric substrate 5. The at least one resonator 4 further has at least one connector 4-5 electrically connecting one of the end segments 4'-3 with the covering second resonating conductor 4-4 on the opposite side of the dielectric substrate 5, short-circuiting the end segment 4-3.

Figure 3B:
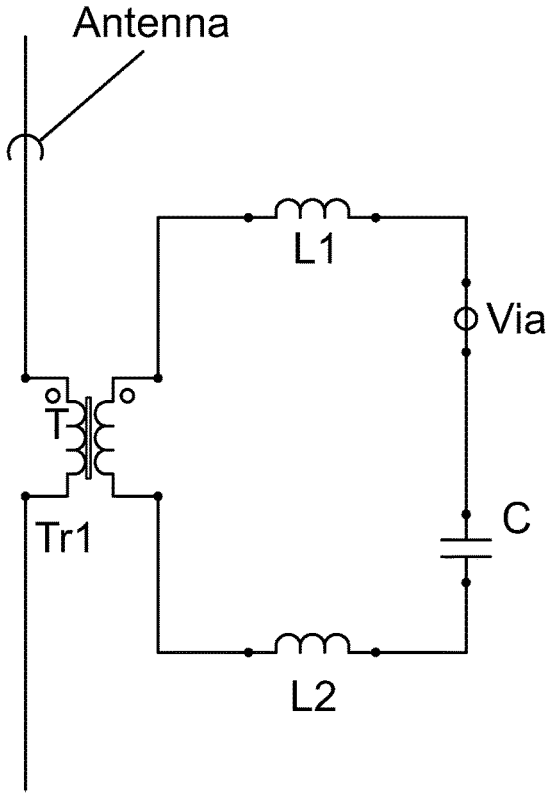
FIG. 3B is a schematic view of an equivalent circuit of the first antenna of FIG. 3A.

Since one of the end segments 4'-3 of the first resonating conductor is short circuited with the second resonating conductor 4-4, only a single capacitor, shown in FIG. 3B, is formed by the other of the two end segments 4'-3 and the second resonating conductor 4-4. This single capacitor has a higher total capacitance than the two capacitors form in the embodiment of FIG. 2, further enhancing the capacitive loading of the at least one resonator 4.

In an embodiment, each of the end segments 4'-3 has an enlarged width at an end compared to the first and intermediate segments 4-1 and 4-2, as shown in FIG. 3A. Consequently, the surface area covered by the first resonating conductor 4-1, 4-2, 4-3 and the second resonating conductor 4-4 increases, thereby resulting in further improved capacitive loading.

Figure 4:
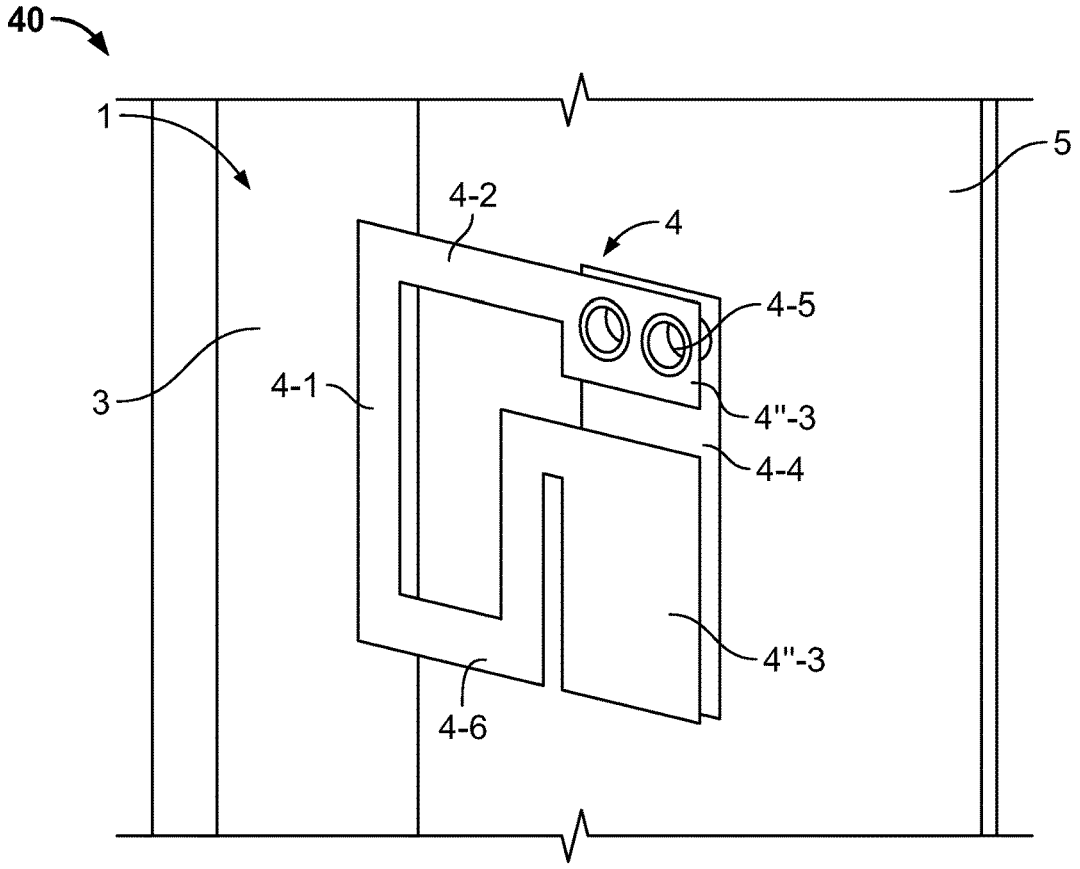
FIG. 4 is a perspective view of a first antenna of an antenna system according to the invention.

An antenna system 40 according to the invention is shown in FIG. 4. The antenna system 40 comprises a first antenna 1 and a second antenna 2. The first antenna 1 has a radiator 3, at least one resonator 4, and a dielectric substrate 5. The radiator 3 is a radiating conductor provided on a first side of a dielectric substrate 5.

The at least one resonator 4 has a first resonating conductor 4-1, 4-2, 4"-3, and 4-6 which is provided on the second, reverse side of the dielectric substrate 5. To increase the inductive value of the resonator 4, at least one of the intermediate intermediate segments 4-2 is routed in a meandering pattern 4-6, in which consecutive loops of conductive segments extend in opposite directions. The meandering segment 4-6 is not covered by the radiator 3.

The meandering segment 4-6 can be applied independently of whether or not the end segments 4-3 are provided with an enlarged width, whether or not a second resonating conductor 4-4 is provided for capacitive loading, or whether or not at least one connector 4-5 is used to short circuit one of end segments 4-3.

Figure 5:
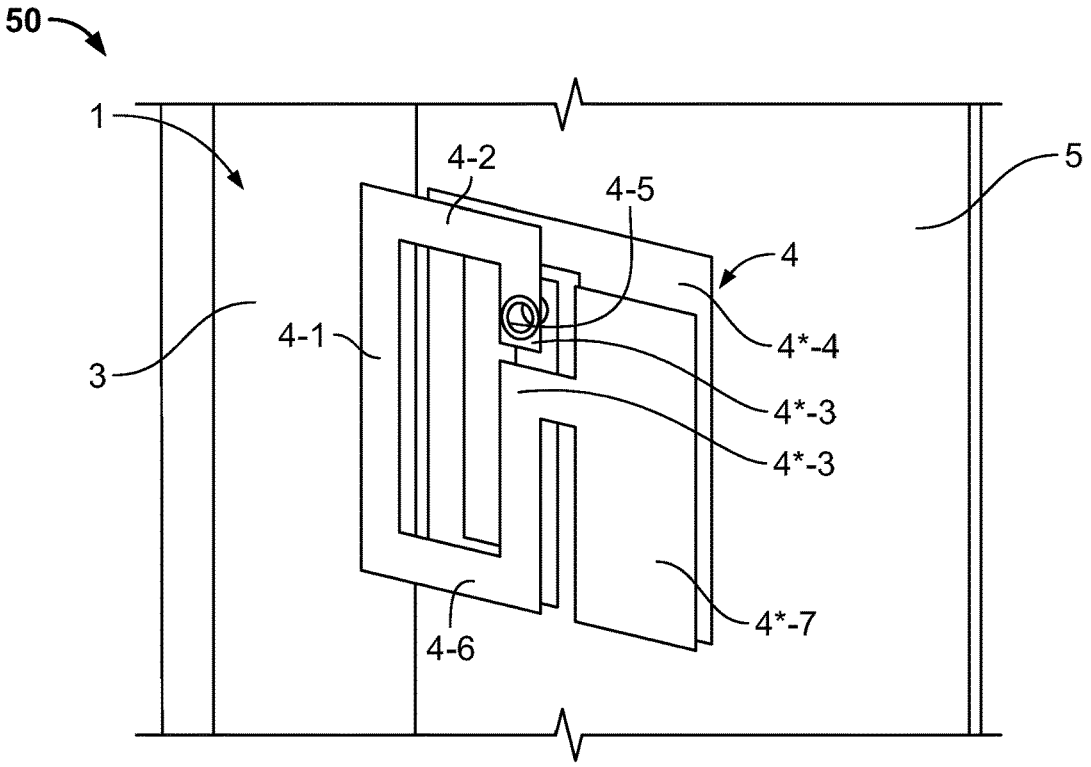
FIG. 5 is a perspective view of a first antenna of an antenna system according to the invention.

An antenna system 50 according to the invention is shown in FIG. 5. The antenna system 50 comprises a first antenna 1 and a second antenna 2. The first antenna 1 has a radiator 3, at least one resonator 4, and a dielectric substrate 5. The radiator 3 is a radiating conductor provided on a first side of a dielectric substrate 5.

The at least one resonator 4 has a first resonating conductor 4-1, 4-2, **4*-3 and 4-6 which is provided on the second, reverse side of the dielectric substrate 5. The first resonating conductor 4-1, 4-2, 4*-3 and 4-6 has a plurality of segments 1, 4-2, 4*-3 and 4-6 forming an open loop with a gap formed between end segments 4*-3. At least one of the end segments 4*-3 is electrically connected to a stub 4*-7** having an enlarged width.

The at least one resonator 4 also has a second resonating conductor **4*-4 which is provided on the first side of the dielectric substrate 5, spatially separated from the radiator 3. The second resonating conductor 4*-4 has an open loop which turns in a same direction as the open loop of the first conductor 4-1, 4-2, 4*-3 and 4-6. The second resonating conductor 4*-4 is partially covered by the stub 4*-7 and separated from the end segments 4*-3 by the thickness of the dielectric substrate 5. The at least one resonator 4 further has at least one connector 4-5 electrically connecting one of the end segments 4*-3 with the covering second resonating conductor 4*-4 on the opposite side of the dielectric substrate 5, short-circuiting the end segment 4-3**.

Since both the first resonating conductor 4-1, 4-2, **4*-3 and 4-6 and the second resonating conductor 4*-4 have an open loop turning in the same direction, the inductive value of the resonator 4 increases, allowing utilization even in a small-profile first antenna 1. The inductive value of the resonator 4 may be further increased by routing at least one of intermediate segments 4-2 of the first conductor 4-1, 4-2, and 4*-3 in a meandering pattern 4-6. The meandering segment 4-6 is not covered by the radiator 3**.

Figure 6A:
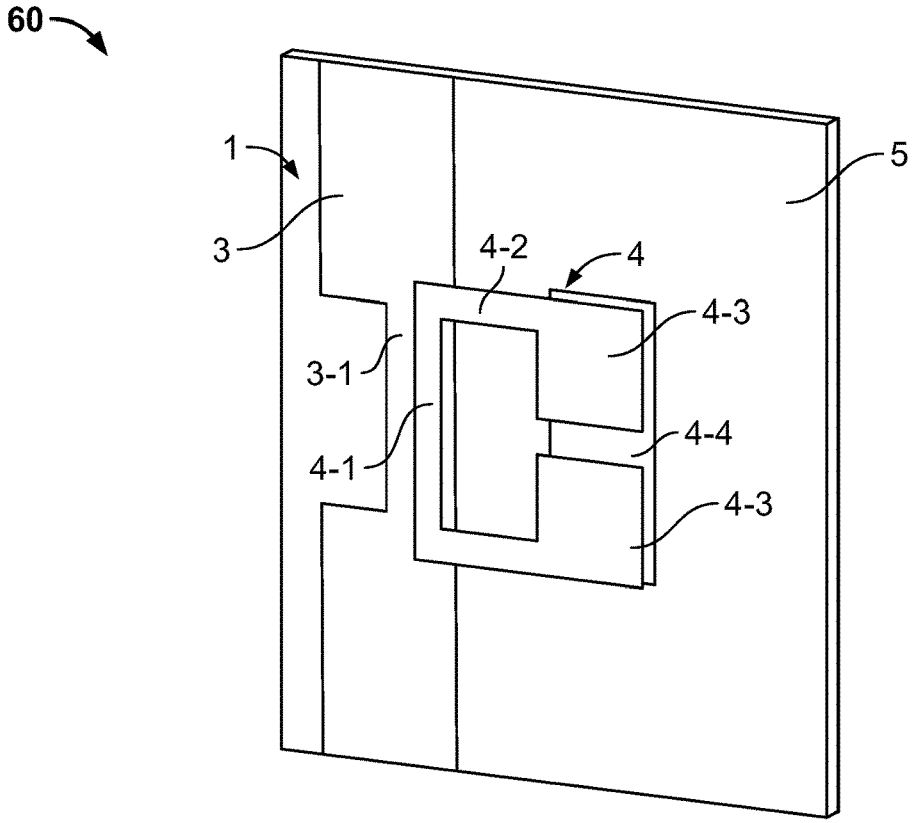
FIG. 6A is a perspective view of a first antenna of an antenna system according to the invention.

An antenna system 60 according to the invention is shown in FIG. 6A. The antenna system 60 comprises a first antenna 1 and a second antenna 2. The first antenna 1 has a radiator 3, at least one resonator 4, and a dielectric substrate 5. The at least one resonator 4 has a first resonating conductor 4-1, 4-2, and 4-3 which is provided on a second, reverse side of the dielectric substrate 5.

The radiator 3 is a radiating conductor provided on a first side of a dielectric substrate 5. The radiator 3 has at least one indent 3-1 in order to further enhance the inductive coupling with the at least one resonator 4. The radiator 3 has a reduced width at the indent 3-1, which overlaps with a covered first segment 4-1 of the at least one resonator 4. In the context of the invention, the width of the radiator 3 shall be understood as the dimension of the radiator 3 extending laterally with respect to the surface of the dielectric substrate 5 on which it is provided. The indent 3-1 enhances the impedance transformation ratio between the radiator 3 and the at least one resonator 4, and hence, improves the useful bandwidth of the effective current cut.

Figure 6B:
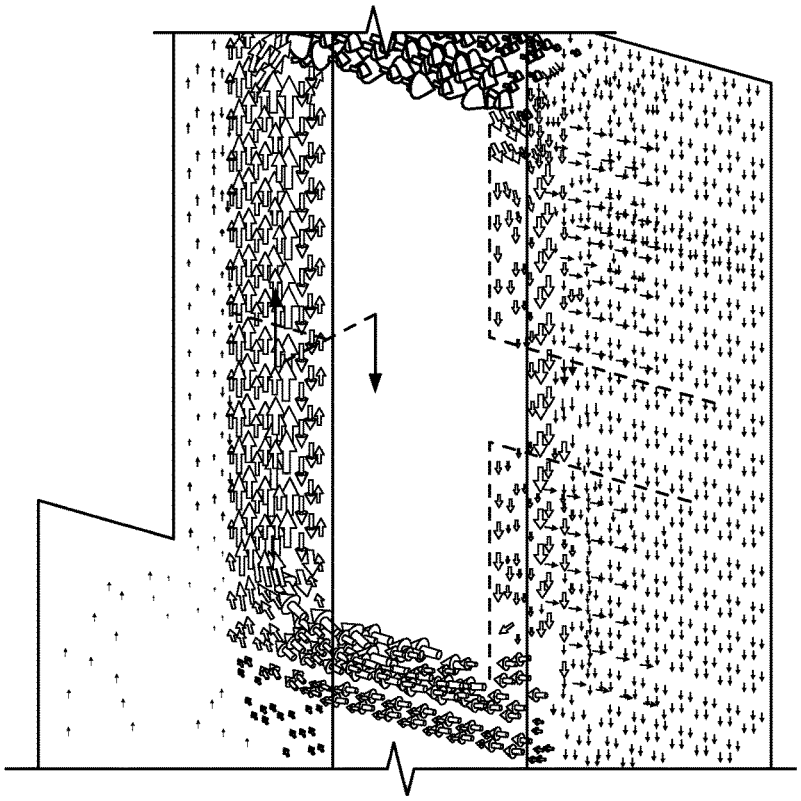
FIG. 6B is a schematic view of a simulated current distribution of the first antenna of FIG. 6A.

As shown in FIG. 6B, the indent 3-1 concentrates the current for the inductive coupling between the radiator 3 and the at least one resonator 4. Notably, at indent 3-1, some current is present which is directed in the opposite direction relative to the current on the covered first segment 4-1.

Each of the above discussed antenna systems 10-60 of the various embodiments can be included in an antenna module (not shown) for use on a vehicle rooftop. For this purpose, the antenna module, in addition to the antenna system 10-60, comprises a housing for protecting the antenna system 10-60 from outside influences, a base for arranging the antenna system thereon, an antenna matching circuit, and an electrical connection for transmitting/receiving electrical signals from the outside to/from the first antenna 1 and the second antenna 2 of the antenna system 10-60. Further, the vehicle rooftop provides a ground plane for the first antenna 1 and the second antenna 2.

What is claimed is:

1. An antenna system, comprising: a first antenna adapted to a first frequency band and having a radiator provided on a first side of a dielectric substrate and at least one resonator, the at least one resonator resonating at a frequency in a second frequency band different from the first frequency band, the resonator has a first resonating conductor provided on the second side of the dielectric substrate and a second resonating conductor provided on the first side of the dielectric substrate, the first resonating conductor is at least partially covered by the radiator and the second resonating conductor is spatially separated from the radiator; and a second antenna adapted to the second frequency band and positioned perpendicular to the first antenna.

2. The antenna system of claim 1, wherein the radiator has an indent with a reduced width, the indent covering the at least one resonator.

3. The antenna system of claim 2, wherein the indent has an opening facing a same direction as the at least one resonator.

4. The antenna system of claim 1, wherein the first resonating conductor has a plurality of segments formed in an open loop.

5. The antenna system of claim 4, wherein the first resonating conductor has a gap formed between two end segments of the open loop.

6. The antenna system of claim 5, wherein at least one intermediate segment of the first resonating conductor extends in a meandering pattern.

7. The antenna system of claim 6, wherein the two end segments of the open loop are not covered by the radiator.

8. The antenna system of claim 7, wherein at least one of the two end segments has an enlarged width.

9. The antenna system of claim 7, wherein at least one of the two end segments is electrically connected to a stub having an enlarged width.

10. The antenna system of claim 5, wherein the second resonating conductor is covered, at least in part, by at least one of the two end segments.

11. The antenna system of claim 10, wherein the second resonating conductor is formed in an open loop which turns in a same direction as the open loop of the first resonating conductor.

12. The antenna system of claim 10, wherein the at least one resonator has at least one connector electrically connecting one of the two end segments with the second resonating conductor.

13. The antenna system of claim 4, wherein the radiator has a plurality of sections radiating at different frequencies within the first frequency band.

14. The antenna system of claim 1, wherein the first antenna is a multi-band planar inverted-F antenna.

15. The antenna system of claim 1, wherein the second antenna is a corner-truncated rectangular patch antenna.

16. An antenna module for use on a vehicle rooftop, comprising: an antenna system comprising a first antenna adapted to a first frequency band and having a radiator provided on a first side of a dielectric substrate and at least one resonator, the at least one resonator resonating at a frequency in a second frequency band different from the first frequency band, the resonator has a first resonating conductor provided on the second side of the dielectric substrate and a second resonating conductor provided on the first side of the dielectric substrate, the first resonating conductor is at least partially covered by the radiator and the second resonating conductor is spatially separated from the radiator, and a second antenna adapted to the second frequency band and positioned perpendicular to the first antenna; wherein the vehicle rooftop provides a ground plane for the first antenna and the second antenna.

17. An antenna system, comprising:

a dielectric substrate;

a first antenna adapted to a first frequency band and having:

(a) three indents, (b) a radiator on a first side of the dielectric substrate, and (c) a plurality of resonators:

(1) on a second opposite side of the dielectric substrate, each of the resonators overlapping with a different one of the three indents, (2) partially covered by the radiator, and (3) resonating at a frequency in a second frequency band different from the first frequency band; and a second antenna adapted to the second frequency band and positioned perpendicular to the first antenna.

18. An antenna module for use on a vehicle rooftop, comprising:

an antenna system comprising:

(a) a dielectric substrate, (b) a first antenna adapted to a first frequency band and having:

(1) the vehicle roof as a ground plane, (2) three indents, (3) a radiator on a first side of the dielectric substrate, and (4) a plurality of resonators:

(i) on a second opposite side of the dielectric substrate, each of the resonators overlapping with a different one of the three indents, (ii) partially covered by the radiator, and (iii) resonating at a frequency in a second frequency band different from the first frequency band; and a second antenna:

(a) adapted to the second frequency band, (b) positioned perpendicular to the first antenna, and (c) having the vehicle roof as a ground plane.

* * * * *